United States Patent [19]

Jolley

[11] Patent Number: 4,997,115

[45] Date of Patent: Mar. 5, 1991

[54] FOLDABLE GARMENT HANGER

[76] Inventor: Geoffrey W. Jolley, 7315 Belleview, Kansas City, Mo. 64114

[21] Appl. No.: 295,306

[22] Filed: Jan. 10, 1989

[51] Int. Cl.[5] ..... A47G 25/40

[52] U.S. Cl. ..... 223/89; 223/94

[58] Field of Search ..... 223/89, 94, 90

[56] References Cited

U.S. PATENT DOCUMENTS

| | | | |
|---|---|---|---|
| 851,527 | 4/1907 | Kronacher | 223/94 |
| 1,374,024 | 4/1921 | Morton | 223/89 |
| 2,123,973 | 7/1938 | Smith | 223/94 |
| 2,420,116 | 5/1947 | Walters | 223/89 |
| 2,425,527 | 8/1947 | Gaudino | 223/94 |
| 2,446,312 | 8/1948 | Usina | 223/89 |
| 2,586,913 | 2/1952 | Burns | 223/94 |
| 3,703,978 | 11/1972 | Sammartino et al. | 223/89 |

FOREIGN PATENT DOCUMENTS

| | | | |
|---|---|---|---|
| 2206434 | 8/1973 | Fed. Rep. of Germany | 223/94 |
| 624950 | 7/1927 | France | 223/94 |
| 629628 | 11/1927 | France | 223/94 |

*Primary Examiner*—Werner H. Schroeder
*Assistant Examiner*—David K. Suto

[57] ABSTRACT

A foldable garmet hanger consisting of a plastic hanger separated at the separation points 32 with springs 24 inserted into the holes 22 at the separation points 32 and plastic tubing 26 encasing the body of the garment hanger below the base of neck 34. The foldable garment hanger can be folded at the separation points 32 so that the two ends of the cross member 30 are on the same side of the separation points 32. Upon releasing the foldable garment hanger it returns to its original extended rigid shape. This permits the hanger to be inserted in the neck of garments such as pullover shirts and turtleneck sweaters without stretching the neck opening of the garment and then to be opened into its extended rigid shape inside the garment so that the garment can be held. The foldable garment hanger can be removed in the same manner to avoid damage to the garment.

5 Claims, 2 Drawing Sheets

FOLDABLE GARMENT HANGER

BACKGROUND OF THE INVENTION

FIELD OF THE INVENTION

This invention relates to garment hangers and specifically to foldable, flexible or collapsible garment hangers.

DESCRIPTION OF THE PRIOR ART

Garment hangers are devices used to hang and store items of clothing or garments when not being worn. Most garment hangers sold commercially are designed to be hung from a pole or rod by a suspension hook, thus permitting people to hang up their clothes in a closet or wardrobe for ready access.

Garment hangers are generally made of wood, plastic or metal wire. Historically, garment hangers have been constructed either (i) with two angular arms of equal length and a suspension hook in the center or (ii) in the shape of a triangle, with a top suspension hook connected to two angular arms of equal length and joined at the bottom by a longer cross member. In recent years, one-piece molded plastic hangers of triangular shape appear to have gained a larger volume of retail sales than wood and wire hangers. Although the garment hangers available in the retail market include several varieties of foldable or collapsible hangers for use in travel, none of the garment hangers available in the retail market today fold or bend in such a way that they can be inserted in the neck opening of a garment in the folded position and then released with one hand to assume the unfolded position inside the garment, without stretching the neck opening beyond its intended shape without undoing the buttons or zipper to enlarge the neck opening.

U.S. Pat. No. 4,227,632 to Collis (1980) discloses a garment hanger which can collapse and be relocked, but it must be manipulated or moved in order to collapse it, and then again to cause it to go in its rigid position for holding garments. While the collapsible feature may be useful for storage of a large number of such hangers, the design of the hanger is such that the collapsible feature is somewhat time-consuming and inconvenient to use, particularly once the garment is on the hanger.

U.S. Pat. No. 3,802,610 to Love (1974) is a collapsible garment hanger that can be collapsed around a spindle arrangement, and then the arms can be extended. Since the arms of the hanger must be manipulated to become extended and made rigid, use of the hanger becomes awkward once it is inserted inside of the garment.

SUMMARY OF THE INVENTION

Several objects and advantages of the present invented foldable garment hanger are as follows:

(a) to provide a garment hanger that can be inserted into the neck opening of a pullover shirt or turtleneck sweater without significant stretching of garment such as the neck opening;

(b) to provide a garment hanger that can be folded for insertion into the neck opening of a garment such as a pullover shirt or turtleneck sweater and will reopen into its rigid extended position without the need for significant manipulation by the user, thus preventing damage to the garment and making the garment hanger more attractive to the user;

(c) to provide a garment hanger which can be inserted in the neck opening of a garment such as pullover shirts and turtleneck sweaters which can be manufactured at a reasonable price;

(d) to provide a garment hanger, with a pleasing appearance that can be inserted in the neck opening of a garment such as pullover shirts and turtleneck sweaters without damage to the neck opening of the garment;

(e) to provide a garment hanger that can be inserted in the neck opening of a garment such as pullover shirts and turtleneck sweaters that operates in such a fashion that it can be used by children and adults; and (f) to provide a garment hanger that can be used for garment such as pullover shirts and turtleneck sweaters without stretching the neck opening but can also be used for many other garments because it retains a shape typically used for garment hangers.

Further objects and advantages will become apparent from a consideration of the ensuing description and drawings.

DESCRIPTION OF THE PREFERRED EMBODIMENTS

Figure 1:
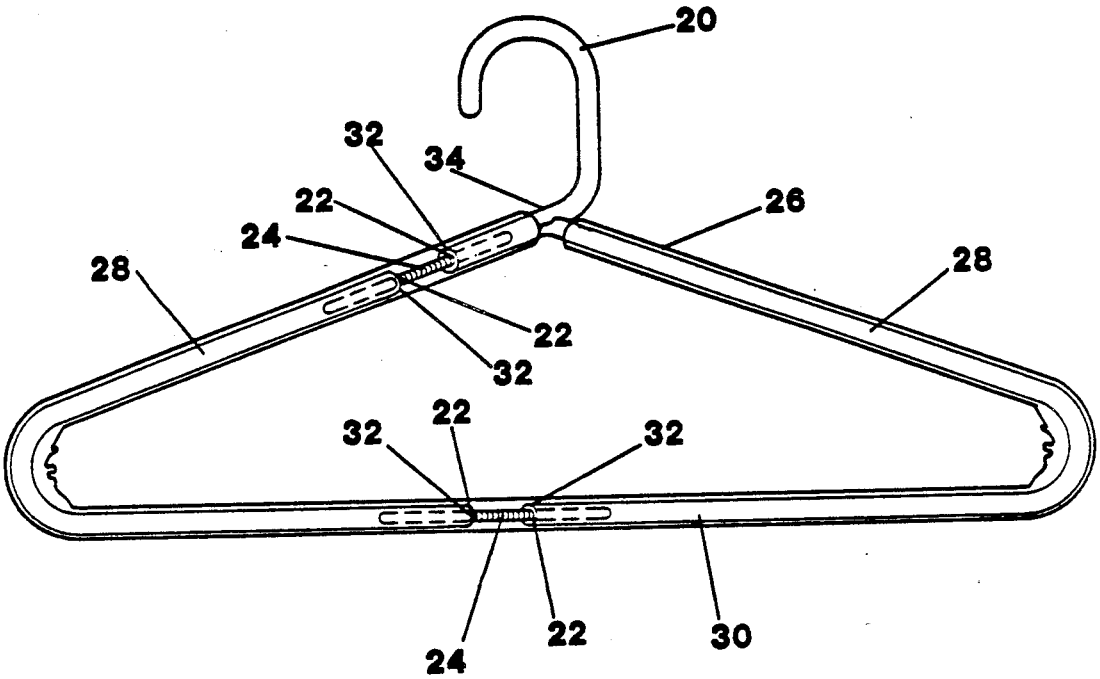
FIG. 1 is a front view of my invention.

FIG. 1 shows the front view of my foldable garment hanger. The garment hanger consists of a segmented molded plastic triangular shaped hanger with hook. Originally one piece of molded plastic, the hanger has been cut or separated at two points in order to form two discrete segments of different size. The first separation is made at the separation point 32 on the angular arm member 28 to the side where the base of hook 34 attaches to the angular arm members 28, and the second separation point 32 is on the cross member 30 immediately below the above-described separation point 32 on the angular arm member 28. A tubular hole 22 of a diameter sufficient to permit the spring 24 to be inserted lengthwise and approximately $\frac{3}{4}$ inch in length is made in each end of each segment of the garment hanger at the separation points 32. Then, a metal extension spring 24 approximately $2\frac{1}{8}$ inches long or similar spiral spring device is inserted into each hole 22 at the seperation point 32 on the angular arm member 28 and a second metal extension spring 24 is inserted into each hole 22 in the cross member 30 at the seperation points 32, thus constituting spring hinges connecting the two portions of the angular arm member 28 to each other at the separation point 32 located on it and connecting the two portions of the cross member 30 to each other at the separation point 32 located on it.

The plastic tubing 26 or sleeve which encases the foldable garment hanger is inserted by removing the spring 24 on the angular arm member 28 and sliding the plastic tubing 26 over the balance of that angular arm member 28 from the separation point 32 away from the base of hook 34, across the cross member 30 and up the other angular arm member 28 to the base of hook 34. The spring 24 is then reinserted in the hole 22 at the separation point 32 on the portion of the angular arm member 28 attached at the base of hook 34 and then inserting that portion of the angular arm member 28 in the end of the plastic tubing 26 that is extending beyond the other segment of such angular arm member 28 until the spring 24 enters the hole on such segment of the angular arm member 28 at the separation point 32.

There are various possibilities with regard to the covering on the angular arm members 28 and the cross member 30. The plastic tubing 26 may be replaced by a different covering material so long as such covering material can bend repeatedly without fracturing. My foldable garment hanger may be made in various colors, and the plastic tubing 26 may be made of the same color as the angular arm members 28 and cross member 30, of a different color or may be clear to permit the working parts of the foldable garment hanger to be visible to the user.

Figure 2:
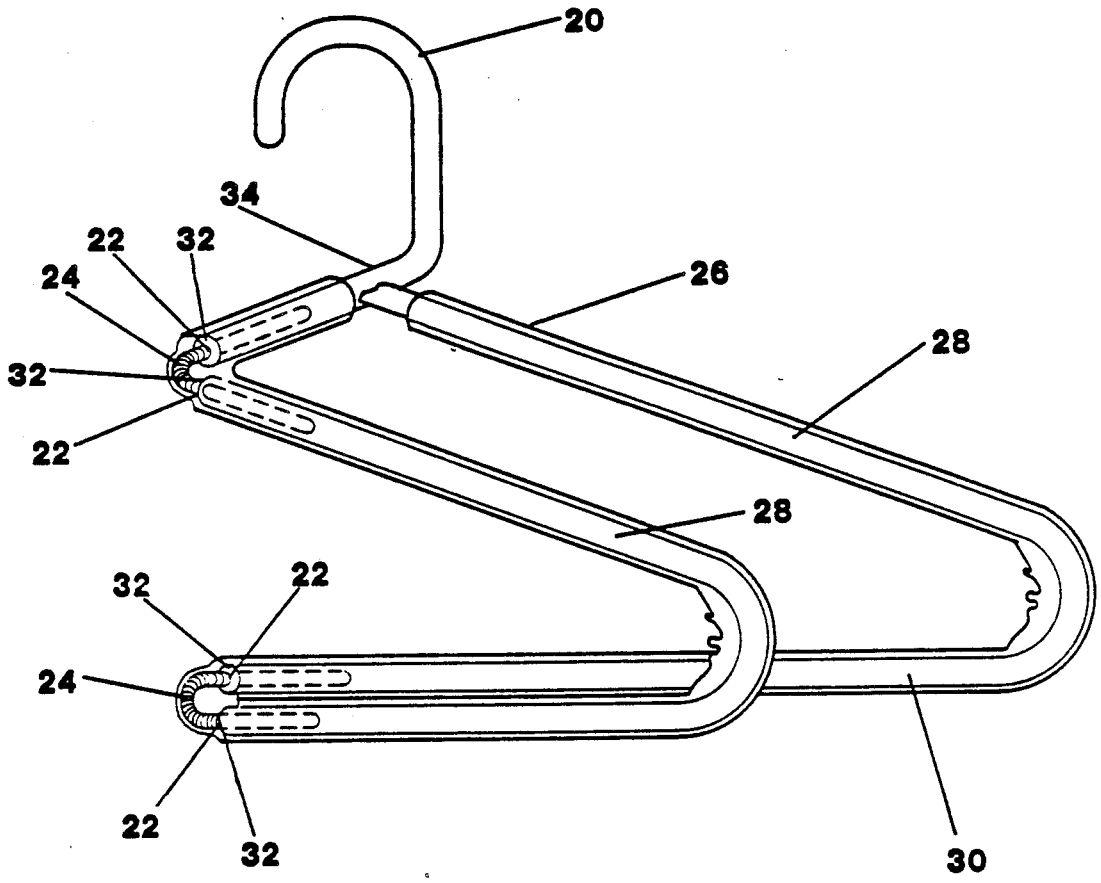
FIG. 2 is a view of my invention when the foldable garment hanger has been completely folded.

FIG. 2 is a diagram of the same foldable garment hanger of FIG. 1 but shows the foldable garment hanger in its fully folded position. This drawing shows the reduction in size that occurs when the hanger is folded. The drawing also shows that the central body of the hanger remains stationary to facilitate inserting the hanger in the garment and causing the garment to be held in the proper fashion once the foldable garment hanger is released and returns to its extended rigid position.

From the description above, a number of advantages of my foldable garment hanger become evident:

(a) The plastic tubing and plastic garment hanger permit the hanger to be made in different colors, which will be more pleasing to the consumer, particularly parents shopping for their children's closets.

(b) The plastic tubing provides a smooth surface over the entire part of the garment hanger where the clothing rests, thus offering additional protection from damage or wrinkling in comparison with metal wire hangers.

(c) The foldable garment hanger can be constructed in different sizes so that it can be produced for use on clothing of children or adults.

The invented foldable garment hanger is operated by bending the spring hinges connecting each segment of the foldable garment hanger, thus causing the smaller angular arm and cross member segment to swing from one side to the other, with the foldable means occurring at the two separation points. The junction of the angular arm member and cross member farthest from the separation points is inserted into the neck opening of a pullover shirt or turtleneck sweater. The foldable garment hanger is inserted until the base of hook and hook ar all that remain above the neck opening of the garment. The two segments of the foldable garment hanger are then released, and the hanger will open so that it can be adjusted into the sleeve holes inside the garment to keep the garment in place.

To remove the foldable garment hanger, the juncture of the angular arm member and cross member closest to the separation points is removed from the arm hole of the garment while the foldable garment hanger is inside the garment. This side of the foldable garment hanger is then folded at the separation points, and while being held in the folded position, the hanger is removed from the garment. Upon being removed from the garment, the two segments of the foldable garment hanger can be released and the hanger will open to its fully extended and rigid position, as maintained by the spring hinges.

Accordingly, the reader will see that the foldable garment hanger can be used conveniently and easily to hang pullover shirts, turtleneck sweaters or other similar non-buttoned garments, without stretching and doing damage to the neck opening of such garments. Furthermore, the foldable garment hanger has additional advantages in that it can be used over and over to hang various garments being used as a regular hanger or a foldable hanger at the option of the user;

the plastic tubing provides a smooth surface upon which the garment will rest so there is no risk of damage to the garment;

the plastic tubing and plastic hanger can be made of the same or different colors to provide a foldable garment hanger that has a pleasing appearance;

the plastic tubing can be clear to permit the user to view the spring hinges in operation, a feature which may be interesting to users, particularly children; and the fact that the foldable garment hanger unfolds virtually automatically upon being released minimizes the manipulation or movement necessary to put the hanger in its extended rigid position, once it is inserted into the garment, or to take it out of the garment. The user can insert the folded hanger and then release it with one hand, while leaving the other hand free to hold the garment.

Although the description above contains many specifications, these should not be construed as limiting the scope of the invention but as merely providing illustrations of some of the presently preferred embodiments of this invention. For example, the foldable garment hanger could be covered with soft cloth or other substance to further protect delicate wool sweaters.

Thus, the scope of the invention should be determined by the appended claims and their legal equivalents, rather than by the examples given.

I claim:

1. A foldable garment hanger comprising a hooked suspension device and a central body comprising angular arms having folding means comprising a first flexible device located between two segments of a first angular arm at a point adjacent to the suspension device, said means operable to bias open the body to an extended position from a closed position and wherein the central body is of triangular shape comprising two angular members each extending from the hooked suspension device and being connected to each other at an end, below said central body, by a cross member which has a second flexible device at a point immediately beneath said first flexible device.

2. The hanger of claim 1 wherein each flexible device comprises a spiral spring device.

3. The hanger of claim 2 wherein said first arm contains a tubular hole on each segment for insertion of said spiral spring device.

4. The hanger of claim 2 wherein each flexible device further comprises a flexible encasement of said spiral spring device.

5. The hanger of claim 1 wherein said central body including said flexible device further comprises a flexible encasement.

* * * * *